US009752499B2

(12) United States Patent
Liu

(10) Patent No.: US 9,752,499 B2
(45) Date of Patent: Sep. 5, 2017

(54) ON-LINE CLEANING CONTROL SYSTEM AND CONTROL METHOD FOR CARBON DEPOSITS IN DIRECT INJECTION ENGINE FUEL SYSTEM

(71) Applicant: Xinyu Liu, Beijing (CN)

(72) Inventor: Xinyu Liu, Beijing (CN)

( * ) Notice: Subject to any disclaimer, the term of this patent is extended or adjusted under 35 U.S.C. 154(b) by 0 days.

(21) Appl. No.: 15/101,895

(22) PCT Filed: Dec. 25, 2013

(86) PCT No.: PCT/CN2013/090404
§ 371 (c)(1),
(2) Date: Jun. 3, 2016

(87) PCT Pub. No.: WO2015/089866
PCT Pub. Date: Jun. 25, 2015

(65) Prior Publication Data

US 2016/0305318 A1 Oct. 20, 2016

(30) Foreign Application Priority Data

Dec. 17, 2013 (CN) ..... 2013 1 0688619

(51) Int. Cl.
*F02B 77/04* (2006.01)
*B08B 9/08* (2006.01)

(52) U.S. Cl.
CPC ..... *F02B 77/04* (2013.01); *B08B 9/0865* (2013.01)

(58) Field of Classification Search
None
See application file for complete search history.

(56) References Cited

U.S. PATENT DOCUMENTS

| | | | | |
|---|---|---|---|---|
| 4,989,561 A | 2/1991 | Hein | ..... | 123/198 A |
| 6,178,977 B1 | 1/2001 | Wells | ..... | 134/102.1 |
| 7,871,473 B2 * | 1/2011 | Lebold | ..... | B08B 3/00 134/123 |

FOREIGN PATENT DOCUMENTS

| | | |
|---|---|---|
| CN | 1639453 A | 7/2005 |
| CN | 203308581 U | 11/2013 |
| JP | 2003-74371 A | 3/2003 |

OTHER PUBLICATIONS

International Search Report of corresponding International PCT Application No. PCT/CN2013/090404, dated Sep. 19, 2014.

* cited by examiner

*Primary Examiner* — Michael Barr
*Assistant Examiner* — Jason Riggleman
(74) *Attorney, Agent, or Firm* — J.C. Patents

(57) ABSTRACT

The present invention discloses an on-line cleaning control system and method for carbon deposits in a direct injection engine fuel system. The system comprises a cleaner tank, a cleaner input pipeline, an electromagnetic flow controller and a control circuit. A liquid transfer pump is in series connection with a pipeline of the cleaner input pipeline and the cleaner tank; when the conditions that fuel is injected through a fuel injector of the engine, the temperature of a three-way catalytic converter is lower than 800° C., the rotational speed of the engine is greater than 1200 rpm and the cleaning time is shorter than set cleaning time are met, the control circuit starts a cleaning working procedure to inject a cleaner into an intake manifold of the engine. According to the present invention, the liquid transfer pump is used for actively injecting the cleaner into an intake valve of the engine, and besides, the optimal cleaning condition of the engine is controlled; a starting switch can be arranged in a cab so that on-line cleaning for the carbon deposits in the (Continued)

intake valve and a combustion chamber of the engine is performed actively according to the usage state of an automobile; and also, by receiving a mileage signal and presetting a mileage starting value in the controller, on-line cleaning for the carbon deposits in the intake valve and the combustion chamber of the engine can be performed automatically and periodically in accordance with mileages.

13 Claims, 4 Drawing Sheets

ON-LINE CLEANING CONTROL SYSTEM AND CONTROL METHOD FOR CARBON DEPOSITS IN DIRECT INJECTION ENGINE FUEL SYSTEM

CROSS-REFERENCE TO RELATED APPLICATION

This application is a national phase application of international application No. PCT/CN2013/090404 filed on Dec. 25, 2013, which in turn claims the priority benefits of Chinese application No. 201310688619.1 filed on Dec. 17, 2013. The contents of these prior applications are hereby incorporated by reference in its entirety.

TECHNICAL FIELD

The present invention relates to peripheral devices of automobile engines, and more particularly to an on-line cleaning control system and control method for carbon deposits in a direct injection engine fuel system.

BACKGROUND ART

In recent years, various countries have paid more and more attentions to the problem of environmental pollution caused by automobiles and raised emission standards for automobiles, causing global major automobile manufacturers to improve traditional automobile engines and develop new engines. The new engines generally use a GDI+ TURBO technology in which GDI is the technology of gasoline direct injection within cylinders, allowing gasoline to be combusted more adequately, improving gasoline economy and reducing emissions, and TURBO is the turbocharging technology that allows the engine to be miniaturized in size, saves materials and gives more power. However, due to the problems of poor quality of oil products, road traffic conditions and environment as well as bad driving habits, carbon deposits and colloids will be formed in the intake valve and combustion chamber of the engine fuel system of an automobile after thousands of kilometers of its traveling, and in particular, these carbon deposits in the intake valve and combustion chamber limit the advanced performances of the engine, such that power cannot be fully improved. Especially, the GDI engines produce more severe carbon deposits in the intake valve and combustion chamber.

For this purpose, fuel additives have been invented to reduce carbon deposits, but in a direct injection engine, fuel injector is mounted within the combustion chamber, making it impossible for the fuel additives to clean away the carbon deposits in the intake valve. The TURBO technology causes the temperature of lubricating oil in the engine to rise to produce more engine oil exhaust gases, as a result of which it is easier for drum type carbon deposits to be formed on an intake valve lever, seriously affecting the effect of air intake and air-fuel ratio. And valve lifter will be pushed against and thus bent when there are severe carbon deposits.

It has been an urgent problem to be solved by automobile manufacturers that carbon deposits and colloids in the intake valve, fuel injector, combustion chamber and spark plug of a direct injection engine are cleaned away in time to give full play to the design performances of the engine.

SUMMARY OF THE INVENTION

An object of the present invention is to provide an on-line cleaning control system and control method for carbon deposits in a direct injection engine fuel system. The system and an electronic control system of the engine form a closed-loop control, an electric pump is used for actively injecting a cleaner into the intake valve of the engine, while at the same time using a rotational speed signal of the automobile engine and a temperature signal of a three-way catalytic converter for optimal control of injection flow, thus realizing regular removal of the carbon deposits in the intake valve and the combustion chamber.

To achieve the above-mentioned object, the technical solution of the present invention is as follows:

An on-line cleaning control system for carbon deposits in a direct injection engine fuel system, comprising a cleaner tank for accommodating an intake valve cleaner, a cleaner input pipeline, electromagnetic flow controllers and a control circuit, the cleaner tank being mounted on a frame of an automobile, one end of the cleaner input pipeline being connected with the cleaner tank while the other end of the cleaner input pipeline being connected to an intake manifold of an engine through the electromagnetic flow controller, a liquid transfer pump is in series connection with a pipeline where the cleaner input pipeline and the cleaner tank are connected; the control output of the control circuit is connected with the liquid transfer pump and the electromagnetic flow controllers, respectively; the input of the control circuit separately receives the input of a three-way catalytic converter temperature signal, the input of an engine rotational speed signal and the input of an engine oil injection signal; a cleaning starting circuit is arranged in the control circuit, and a starting signal controlled by the operating state of the engine of the automobile is connected to the starting circuit in the control circuit.

Further more, the starting signal is a button switch signal set in a cab, an engine operating/stopping signal phase and an output starting signal, the starting circuit is a signal trigger, and when the engine operates, a button switch is pressed, and the starting signal enables the trigger to trigger the control circuit to enter a cleaning working procedure.

Further more, the starting signal is a mileage counting signal of the automobile, the starting circuit is a mileage counting controller, and a preset mileage register and a mileage counter performing value comparison with the mileage register are arranged in the mileage counting controller, the mileage counting signal is connected with the counting input of the mileage counter, and when the mileage value of the mileage counter reaches a preset value of the preset mileage register, the output of the mileage counting controller triggers the control circuit to enter the cleaning working procedure.

Further more, the cleaner input pipeline comprises a main pipe and branch pipes branching from the main pipe, the branch pipes are connected to pipes where the intake manifold are connected with cylinders of the engine, and the electromagnetic flow controllers are arranged on the branch pipe.

An on-line cleaning control method for carbon deposits based on the system for carbon deposits in a direct injection engine fuel system, comprising the first step of starting the engine and the second step of triggering the control circuit of the system to start working, when the conditions that fuel is injected through a fuel injector of the engine, the temperature of the three-way catalytic converter is lower than a set value, the rotational speed of the engine is greater than a set value and the cleaning time is shorter than set cleaning time are met, the control circuit starts the cleaning working procedure to inject a cleaner into the intake manifold of the engine.

Further more, the set value for the temperature of the three-way catalytic converter is 800° C., and the set value for the rotational speed of the engine is 1200 rpm.

Further more, the control method further comprises:

a. inputting a preset mileage to a preset mileage register, wherein the preset mileage is a mileage where carbon deposits in an intake valve and a combustion chamber need to be cleaned when the traveling distance of the automobile reaches this mileage;

b. reading the mileage data of a mileage counter, and comparing the mileage date with the preset mileage;

c, when the mileage data is equal to the preset mileage, starting the cleaning working procedure and resetting the mileage counter, and if the mileage data is smaller than the preset mileage, returning to the step b.

Further more, the cleaning time is the time for injecting the cleaner into the intake manifold of the engine during the cleaning working procedure.

Further more, the cleaning time is 15 to 25 minutes.

Further more, the injection of the cleaner into the intake manifold of the engine is that the cleaner is injected into the intake manifold of the engine at a flow of 10 g±0.5 g/min.

The present invention has the following advantages over the prior art:

1. On-line cleaning for the carbon deposits in the intake valve and the combustion chamber of the engine is realized without changing the existing basic design of automobiles, indicating that the control method is simple and practical.

2. Due to the introduction of the liquid transfer pump into the system, the cleaner is actively injected into the intake valve of the engine by using the liquid transfer pump, and meanwhile, the rotational speed signal of the automobile engine and the temperature signal of the three-way catalytic converter are utilized for optimal control of injection flow.

3. In the system, a starting switch can be arranged in the cab so that on-line cleaning for the carbon deposits in the intake valve and the combustion chamber of the engine is performed actively according to the usage state of the automobile; and also, by receiving a mileage signal and presetting a mileage starting value in the controller, on-line cleaning for the carbon deposits in the intake valve and combustion chamber of the engine can be performed automatically and periodically in accordance with mileages.

The present invention will be described below in details with reference to the accompanying drawings and embodiments.

DETAILED DESCRIPTION OF THE INVENTION

Embodiment 1

Figure 1:
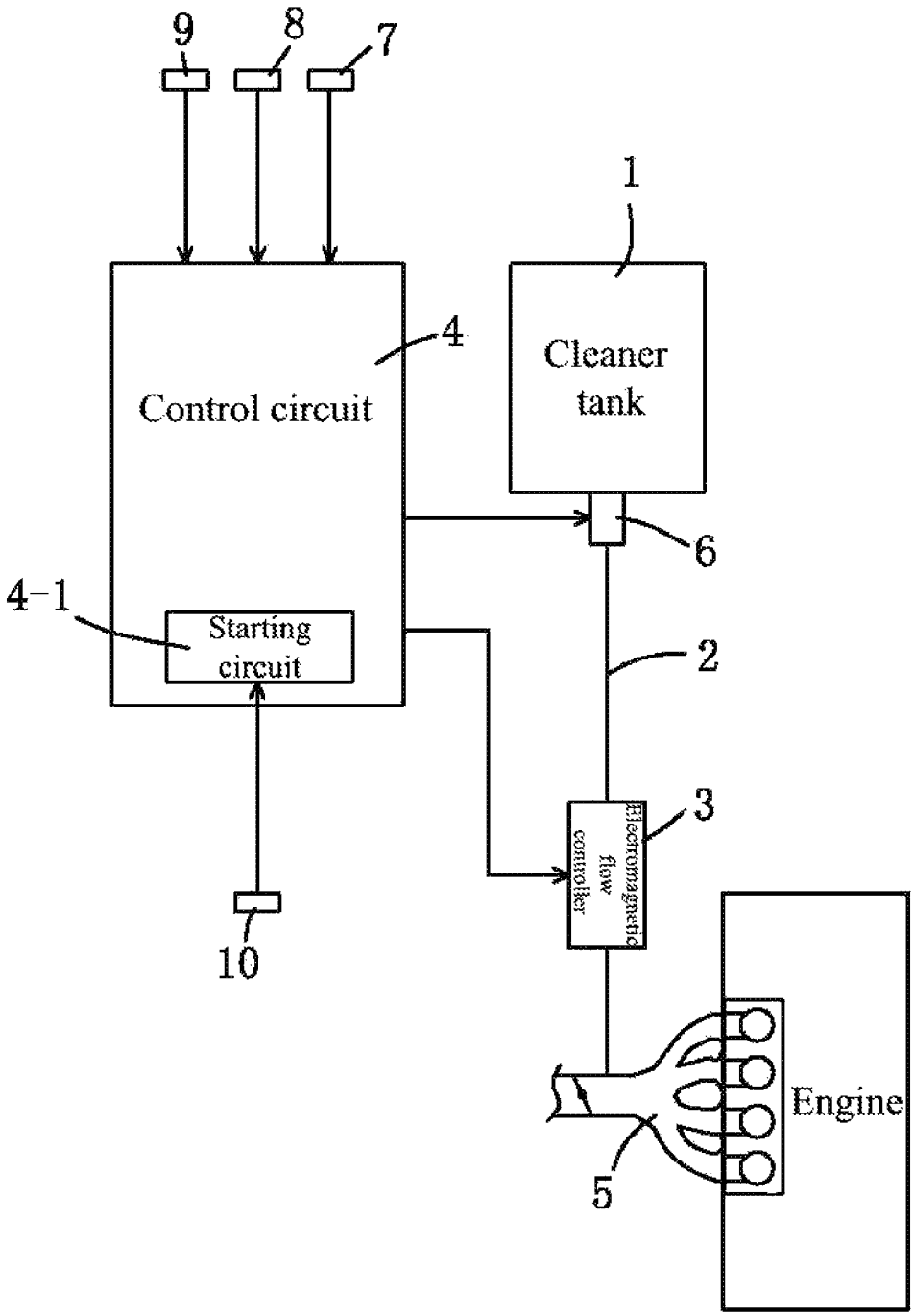
FIG. 1 is a structural schematic diagram of the system of the present invention.

An on-line cleaning control system for carbon deposits in a direct injection engine fuel system, as shown in FIG. 1, comprises a cleaner tank 1 for accommodating an intake valve cleaner, a cleaner input pipeline 2, an electromagnetic flow controller 3 and a control circuit 4, the cleaner tank is mounted on a frame of an automobile, one end of the cleaner input pipeline is connected with the cleaner tank, and the other end of the cleaner input pipeline is connected to an intake manifold 5 of the engine through the electromagnetic flow controller; wherein a liquid transfer pump 6 is in series connection with a pipeline through which the cleaner input pipeline is connected with the cleaner tank, the liquid transfer pump may be an electrically driven electric pump or a pneumatically driven air pump, and the electric pump is used in this embodiment; the control output of the control circuit is connected with the liquid transfer pump and the electromagnetic flow controller, respectively, the input of the control circuit receives the input of a three-way catalytic converter temperature signal 7, the input of an engine rotational speed signal 8 and the input of an engine oil injection signal 9, a cleaning starting circuit 4-1 is arranged in the control circuit, and a starting signal 10 controlled by the operating state of the automobile engine is connected with the starting circuit in the control circuit; wherein the three-way catalytic converter temperature signal, the engine rotational speed signal and the engine oil injection signal can all be obtained from a control panel for an engine control signal in current automobiles; and if no control panel is present, then a three-way catalytic converter temperature sensor, an engine rotational speed sensor and an engine oil injection sensor are arranged to obtain the three-way catalytic converter temperature signal, the engine rotational speed signal and the engine oil injection signal.

Figure 2:
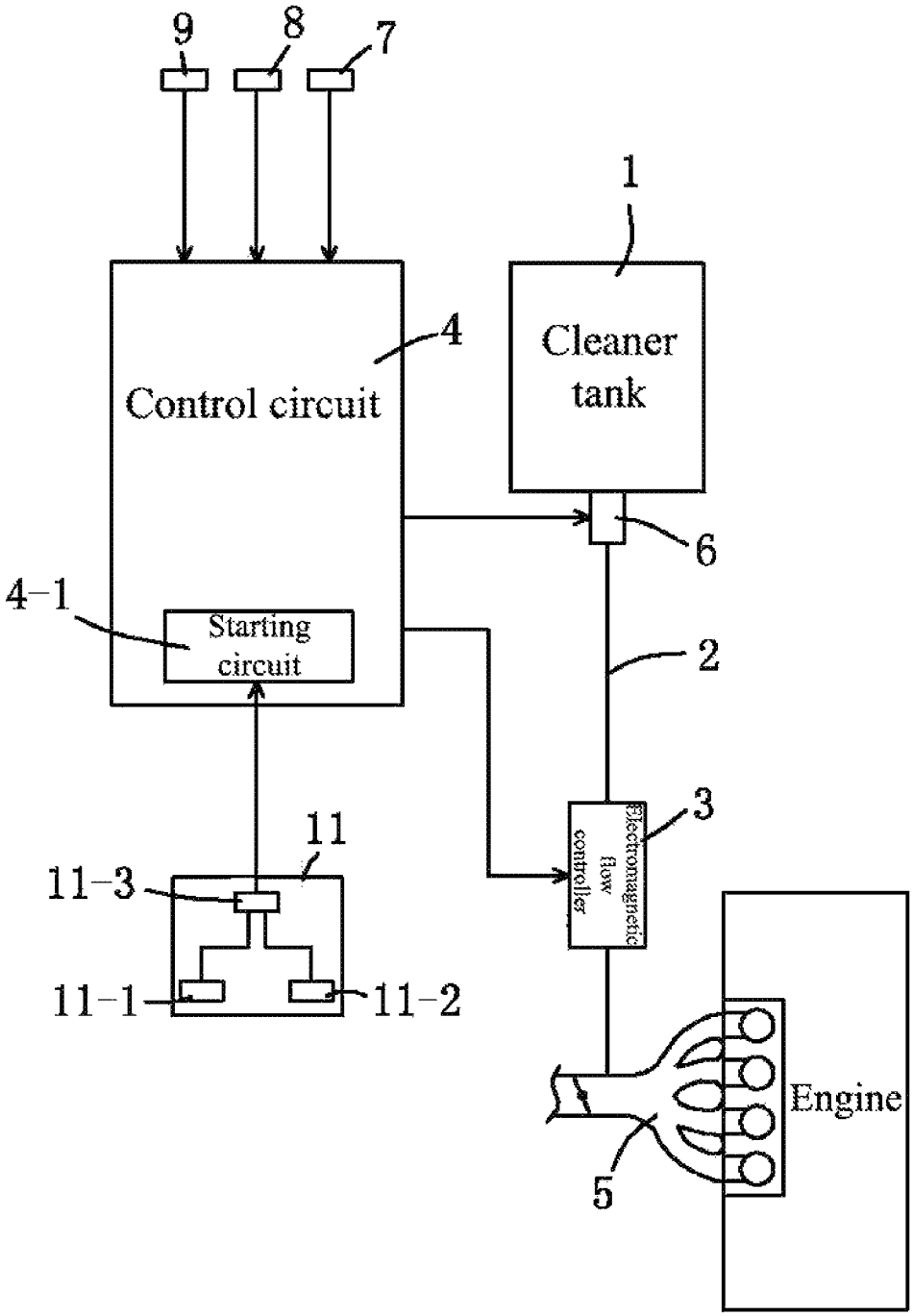
FIG. 2 is a schematic diagram showing a starting signal source of the system of the present invention.

The starting signal in the embodiment at least has two sources:

One of these sources is as shown in FIG. 2, the starting signal is a switch signal transmitted from a button switch 11 arranged in a cab and is a button switch signal set in a cab, an engine operating/stopping signal phase and an output starting signal, the starting circuit is a signal trigger, the starting circuit is a signal trigger, and when the engine operates, the button switch is pressed down, the starting signal enables the trigger to trigger the control circuit to enter a cleaning working procedure; the button switch consists of a key switch signal 11-1, a dialing switch signal 11-2 and an AND gate 11-3 in FIG. 2, and the engine operating/stopping signal can be extracted from an automobile starting key door.

Figure 3:
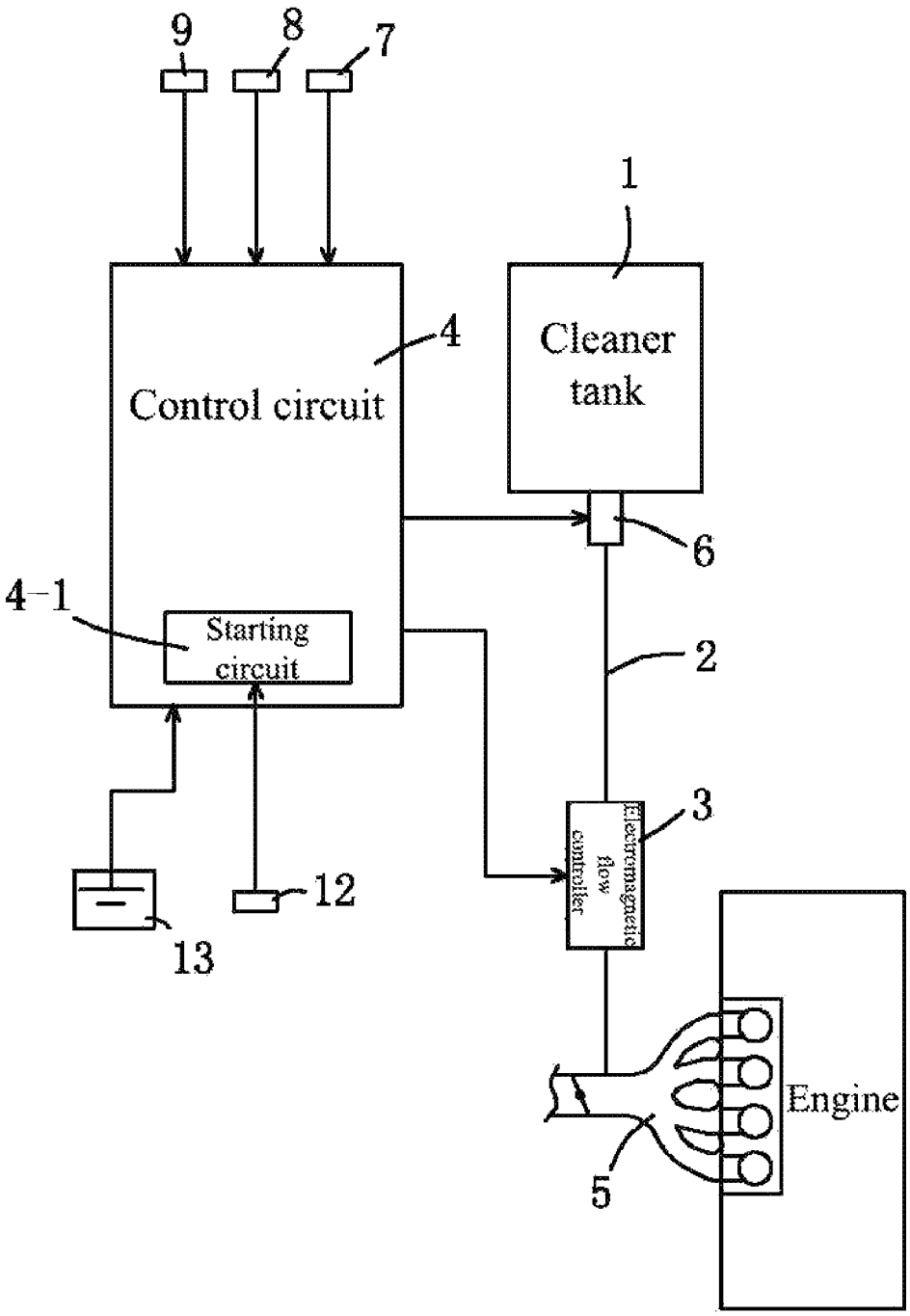
FIG. 3 is a schematic diagram showing another starting signal source of the system of the present invention.

The other source is as shown in FIG. 3, the starting signal is a starting signal transmitted from an automobile mileage counting signal 12 under control, the starting circuit is a mileage counting controller, a preset mileage register and a mileage counter performing value comparison with the mileage register are arranged in the mileage counting controller, the mileage counting signal is connected with the counting input of the mileage counter, and when the mileage value of the mileage counter reaches a preset value of the preset mileage register, the output of the mileage counting controller triggers the control circuit to enter the cleaning working procedure; such a scheme is a scheme of self-cleaning, in which by inputting a mileage to the preset mileage register, the system can be automatically started when the traveling distance of the automobile reaches the set mileage; if this starting function is adopted, a lithium battery 13 (which is chargeable) needs to be connected to the control circuit and serves to prevent loss of data in the starting circuit.

Figure 4:
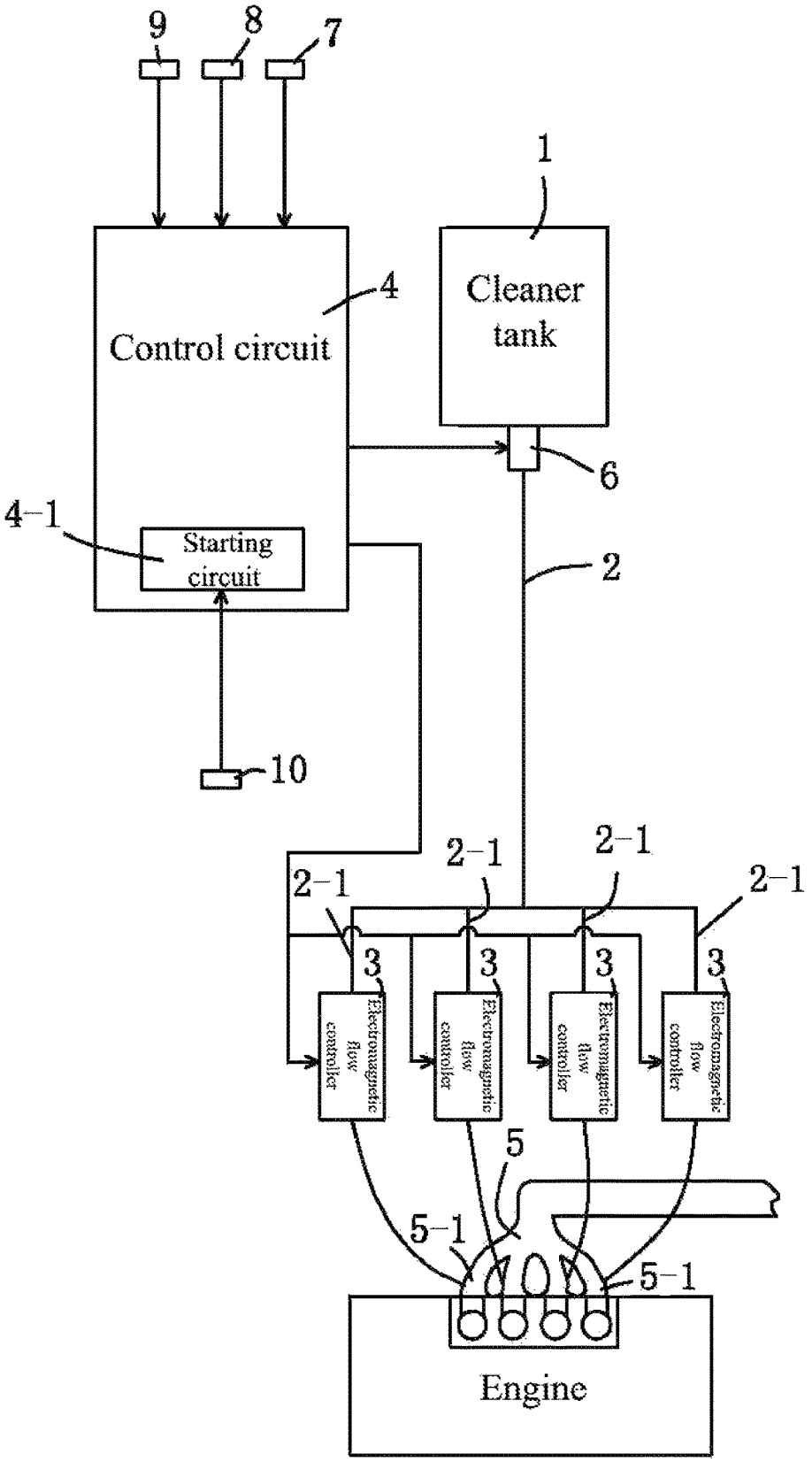
FIG. 4 is a structural schematic diagram of the system of the present invention with branch pipes of a cleaner input pipeline.

In the embodiment, in order to perform controlled cleaning on the carbon deposits in the intake valve and combustion chamber of each cylinder of the engine respectively, as shown in FIG. 4, the cleaner input pipeline comprises a main pipe and branch pipes 2-1 branching from the main pipe 2, the branch pipes are connected to pipes 5-1 where the intake manifold is connected with the cylinders of the engine, and the electromagnetic flow controllers are arranged on the branch pipes.

The control circuit in the embodiment may have various schemes. The control circuit in this embodiment comprises a single chip microcomputer having a tunable pulse width/pulse frequency output port (PWM) and a plurality of data input/output ports (D0-D7, P1-P3), and a liquid crystal display, a parameter setting key, a signal input interface and an electromagnetic flow control interface are disposed around the single chip microcomputer; wherein the liquid crystal display is connected with the data output port of the single chip microcomputer through a liquid crystal display driver, the parameter setting key is connected with the data input port of the single chip microcomputer; the three-way catalytic converter temperature signal, the engine rotation speed signal, the engine oil injection signal and the mileage counting signal are connected to the signal input interface of the single chip microcomputer, and the electromagnetic flow control interface is a tunable pulse width/pulse frequency output port of the single chip microcomputer.

The single chip microcomputer in the embodiment is a commercially available 8-bit single chip microcomputer with memory. The single chip microcomputer used in this embodiment is an 8-bit single chip microcomputer with 24K flash memory, the model of which is STC125624. The liquid crystal display driver is a commercially available liquid crystal display driver, the model of which is HT1621. The electromagnetic flow control interface comprises the tunable pulse width/pulse frequency output port of the single chip microcomputer and a bipolar transistor drive connected with the tunable pulse width/pulse frequency output port of the single chip microcomputer.

In the system, a working display signal lamp and a cleaner liquid level display lamp are arranged on a dashboard. The lamps are on when the system is working, indicating that the intake valve undergoes on-line cleaning. A liquid level sensor is arranged on the cleaner tank, and the system calculates the amount of the consumed liquid according to the liquid level sensor or a set flow and working time. When the cleaner is deficient, the cleaner liquid level display lamp will flicker.

Embodiment 2

An on-line cleaning control method for carbon deposits based on the on-line cleaning control system for carbon deposits in a direct injection engine fuel system according to Embodiment 1 is given, and the content in Embodiment 1 should also be regarded as the content of this embodiment. The method comprises a first step of starting an engine and a second step of triggering a control circuit of the system to start working; wherein when the conditions that fuel is injected through a fuel injector of the engine, the temperature of a three-way catalytic converter is lower than a set value of 800° C., the rotational speed of the engine is greater than a set value of 1200 rpm and the cleaning time is shorter than set cleaning time are met, the control circuit starts a cleaning working procedure to inject a cleaner into an intake manifold of the engine.

The above-mentioned method ensures the optimal working state of cleaning for the engine: in other words, when any of the three conditions that the rotational speed of the engine is smaller than 1200 rpm, the temperature of the three-way catalytic converter is greater than 800° C. and fuel is not injected through the fuel injector appears, the system stops working.

In the embodiment, the control method further comprises:

a. inputting a preset mileage to a preset mileage register, wherein the preset mileage is a mileage where carbon deposits in an intake valve and a combustion chamber need to be cleaned when the traveling distance of the automobile reaches this mileage;

b. reading the mileage data of a mileage counter, and comparing the mileage date with the preset mileage;

c, when the mileage data is equal to the preset mileage, starting the cleaning working procedure and resetting the mileage counter, and if the mileage data is smaller than the preset mileage, returning to the step b.

In the embodiment, the cleaning time is the time for injecting the cleaner into the intake manifold of the engine during the cleaning working procedure.

In the embodiment, the cleaning time is 15-25 minutes.

In the embodiment, the preset mileage can be set arbitrarily based on driving habits and environments. The preset mileage in this embodiment is set to be 3,000 kilometers.

In the embodiment, the injection of the cleaner into the intake manifold of the engine is that the cleaner is injected into the intake manifold of the engine at a flow of 10 g±0.5 g/min (10 g per minute, with an error of ±0.5 g).

In the embodiment, the opening flow of the electromagnetic flow controllers is determined by controlling the opening time per minute of an electromagnetic valve, and when the opening time per minute (T) of the electromagnetic flow meter is 15.2 milliseconds, the actually-measured corresponding flow (L) is equal to 10.1 g/min.

What is claimed is:

1. An on-line cleaning control system for carbon deposits in a direct injection engine fuel system, comprising a cleaner tank for accommodating an intake valve cleaner, a cleaner input pipeline, electromagnetic flow controllers and a control circuit, the cleaner tank being mounted on a frame of an automobile, one end of the cleaner input pipeline being connected with the cleaner tank while the other end of the cleaner input pipeline being connected to an intake manifold of an engine through the electromagnetic flow controller, characterized in that a liquid transfer pump is in series connection with a pipeline where the cleaner input pipeline and the cleaner tank are connected; the control output of the control circuit is connected with the liquid transfer pump and the electromagnetic flow controllers, respectively; the input of the control circuit separately receives the input of a three-way catalytic converter temperature signal, the input of an engine rotational speed signal and the input of an engine oil injection signal; a cleaning starting circuit is arranged in the control circuit, and a starting signal controlled by the operating state of the engine of the automobile is connected to the starting circuit in the control circuit.

2. The on-line cleaning control system for carbon deposits in a direct injection engine fuel system according to claim 1, characterized in that the starting signal is a button switch signal set in a cab, an engine operating/stopping signal phase and an output starting signal, the starting circuit is a signal trigger, and when the engine operates, a button switch is pressed, and the starting signal enables the trigger to trigger the control circuit to enter a cleaning working procedure.

3. The on-line cleaning control system for carbon deposits in a direct injection engine fuel system according to claim 1, characterized in that the starting signal is a mileage counting signal of the automobile, the starting circuit is a mileage counting controller, and a preset mileage register and a mileage counter performing value comparison with the mileage register are arranged in the mileage counting controller, the mileage counting signal is connected with the counting input of the mileage counter, and when the mileage value of the mileage counter reaches a preset value of the preset mileage register, the output of the mileage counting controller triggers the control circuit to enter the cleaning working procedure.

4. The on-line cleaning control system for carbon deposits in a direct injection engine fuel system according to claim 1, characterized in that the cleaner input pipeline comprises a main pipe and branch pipes branching from the main pipe, the branch pipes are connected to pipes where the intake manifold are connected with cylinders of the engine, and the electromagnetic flow controllers are arranged on the branch pipe.

5. An on-line cleaning control method for carbon deposits based on the system according to claim 1, comprising the first step of starting the engine and the second step of triggering the control circuit of the system to start working, characterized in that when the conditions that fuel is injected through a fuel injector of the engine, the temperature of the three-way catalytic converter is lower than a set value, the rotational speed of the engine is greater than a set value and the cleaning time is shorter than set cleaning time are met, the control circuit starts the cleaning working procedure to inject a cleaner into the intake manifold of the engine.

6. The method according to claim 5, characterized in that the set value for the temperature of the three-way catalytic converter is 800° C., and the set value for the rotational speed of the engine is 1200 rpm.

7. The method according to claim 5, characterized in that the control method further comprises:

a. inputting a preset mileage to a preset mileage register, wherein the preset mileage is a mileage where carbon deposits in an intake valve and a combustion chamber need to be cleaned when the traveling distance of the automobile reaches this mileage;

b. reading the mileage data of a mileage counter, and comparing the mileage date with the preset mileage;

c, when the mileage data is equal to the preset mileage, starting the cleaning working procedure and resetting the mileage counter, and if the mileage data is smaller than the preset mileage, returning to the step b.

8. The method according to claim 5, characterized in that the cleaning time is the time for injecting the cleaner into the intake manifold of the engine during the cleaning working procedure.

9. The method according to claim 7, characterized in that the cleaning time is 15 to 25 minutes.

10. The method according to claim 5, characterized in that the injection of the cleaner into the intake manifold of the engine is that the cleaner is injected into the intake manifold of the engine at a flow of 10 g±0.5 g/min.

11. An on-line cleaning control method for carbon deposits based on the system according to claim 2, comprising the first step of starting the engine and the second step of triggering the control circuit of the system to start working, characterized in that when the conditions that fuel is injected through a fuel injector of the engine, the temperature of the three-way catalytic converter is lower than a set value, the rotational speed of the engine is greater than a set value and the cleaning time is shorter than set cleaning time are met, the control circuit starts the cleaning working procedure to inject a cleaner into the intake manifold of the engine.

12. An on-line cleaning control method for carbon deposits based on the system according to claim 3, comprising the first step of starting the engine and the second step of triggering the control circuit of the system to start working, characterized in that when the conditions that fuel is injected through a fuel injector of the engine, the temperature of the three-way catalytic converter is lower than a set value, the rotational speed of the engine is greater than a set value and the cleaning time is shorter than set cleaning time are met, the control circuit starts the cleaning working procedure to inject a cleaner into the intake manifold of the engine.

13. An on-line cleaning control method for carbon deposits based on the system according to claim 4, comprising the first step of starting the engine and the second step of triggering the control circuit of the system to start working, characterized in that when the conditions that fuel is injected through a fuel injector of the engine, the temperature of the three-way catalytic converter is lower than a set value, the rotational speed of the engine is greater than a set value and the cleaning time is shorter than set cleaning time are met, the control circuit starts the cleaning working procedure to inject a cleaner into the intake manifold of the engine.

* * * * *